US009927186B2

(12) United States Patent
Hiwatashi et al.

(10) Patent No.: US 9,927,186 B2
(45) Date of Patent: Mar. 27, 2018

(54) PLATE HEAT EXCHANGER

(75) Inventors: Isamu Hiwatashi, Higashi-Osaka (JP); Mana Iwaki, Higashi-Osaka (JP); Kenji Kusunoki, Higashi-Osaka (JP); Seiichi Matsumura, Hitachi (JP); Kiyoshi Ishihama, Hitachi (JP); Funabiki Takahisa, Hitachi (JP)

(73) Assignees: Hisaka Works, Ltd., Osaka, Osaka (JP); Hitachi-GE Nuclear Energy, Ltd., Hitachi-shi, Ibaraki (JP)

( * ) Notice: Subject to any disclaimer, the term of this patent is extended or adjusted under 35 U.S.C. 154(b) by 638 days.

(21) Appl. No.: 14/344,901

(22) PCT Filed: Sep. 13, 2012

(86) PCT No.: PCT/JP2012/073399

§ 371 (c)(1),
(2), (4) Date: Mar. 13, 2014

(87) PCT Pub. No.: WO2013/039127

PCT Pub. Date: Mar. 21, 2013

(65) Prior Publication Data

US 2014/0367075 A1 Dec. 18, 2014

(30) Foreign Application Priority Data

Sep. 14, 2011 (JP) ..... 2011-200861

(51) Int. Cl.

| | |
|---|---|
| ***F28F 3/08*** | (2006.01) |
| ***F28F 3/10*** | (2006.01) |
| ***F28F 9/02*** | (2006.01) |
| ***F28D 9/00*** | (2006.01) |

(52) U.S. Cl.

CPC ..... *F28F 3/10* (2013.01); *F28D 9/005* (2013.01); *F28F 9/0251* (2013.01); *F28F 3/083* (2013.01);

(Continued)

(58) Field of Classification Search

CPC ..... F28F 3/083; F28F 3/10; F28F 2265/06; F28F 2265/22

(Continued)

(56) References Cited

U.S. PATENT DOCUMENTS 3,099,520 A * 7/1963 Hallstrom ..... F28F 3/083 165/70
4,182,407 A * 1/1980 Lagerwerf ..... F28F 9/0229 165/70

(Continued)

FOREIGN PATENT DOCUMENTS

CN 2655161 Y 11/2004
CN 102095321 A 6/2011

(Continued)

OTHER PUBLICATIONS

Extended European Search Report dated Jul. 27, 2015 in Application No. 12831668.4.

(Continued)

*Primary Examiner* — Leonard R Leo
(74) *Attorney, Agent, or Firm* — Knobbe, Martens, Olson & Bear, LLP

(57) ABSTRACT

To provide a plate heat exchanger free from degradation of gaskets which form a flow path through which a high-temperature fluid flows. In the plate heat exchanger, a plurality of heat transfer plates 20 each provided with passage holes 21, 22, 23, and 24 in corners are stacked; a flow-path forming gasket 31 is interposed between peripheries of each adjacent ones of the heat transfer plates 20; communicating-path forming gaskets 32 are installed, surrounding the passage holes 21 in each adjacent ones of the heat transfer plates 20 alternately; and thereby a first flow path 1 adapted to pass a high-temperature fluid H, a second flow path adapted to pass a low-temperature fluid C, and communicating paths 3 adapted to cause the high-tempera- (Continued)

ture fluid H and the low-temperature fluid C, respectively, to flow in and out of the first flow path 1 and the second flow path 2 are formed alternately on opposite sides of each of the heat transfer plates 20. The flow-path forming gasket 31 is made up of an inner gasket member 31*a* and an outer gasket member 31*b* arranged in two parallel lines.

3 Claims, 9 Drawing Sheets

(52) U.S. Cl.
CPC ..... *F28F 2230/00* (2013.01); *F28F 2265/06* (2013.01); *F28F 2265/16* (2013.01); *F28F 2265/22* (2013.01)

(58) Field of Classification Search
USPC ..... 165/70, 167
See application file for complete search history.

(56) References Cited

U.S. PATENT DOCUMENTS 4,252,182 A * 2/1981 Fender ..... F28F 9/18 165/70
4,372,375 A * 2/1983 Bond ..... F28F 3/083 165/167
5,193,612 A * 3/1993 Stirnkorb ..... F28F 3/10 165/167
5,860,470 A * 1/1999 Andersson ..... F28F 3/083 165/167

FOREIGN PATENT DOCUMENTS

| | | | |
|---|---|---|---|
| JP | H02-57897 | A | 2/1990 |
| JP | H02-192598 | A | 7/1990 |
| JP | H05-264192 | A | 10/1993 |
| JP | 09-72686 | A | 3/1997 |
| JP | 2000-283687 | A | 10/2000 |
| JP | 2005-106412 | A | 4/2005 |
| JP | 2008-51390 | A | 3/2008 |

OTHER PUBLICATIONS

Office Action dated Jul. 20, 2015 in Chinese Application No. 201280044457.1.

* cited by examiner

PLATE HEAT EXCHANGER

CROSS REFERENCE TO RELATED APPLICATIONS

This application is the U.S. National Phase under 35. U.S.C. §371 of International Application PCT/JP2012/073399, filed Sep. 13, 2012, which claims the priority to Japanese Patent Application No. 2011-200861, filed Sep. 14, 2011, the disclosure of which is incorporated herein by reference in its entirety.

FIELD OF THE INVENTION

The present invention relates to a plate heat exchanger for exchanging heat between a high-temperature fluid and a low-temperature fluid, and more particularly, to a plate heat exchanger in which by stacking plural heat transfer plates and interposing a gasket between peripheries or the like of each adjacent ones of the heat transfer plates, a flow path adapted to pass a high-temperature fluid and a flow path adapted to pass a low-temperature fluid are formed alternately between each adjacent heat transfer plates.

RELATED ART

In a plate heat exchanger, plural heat transfer plates 20 are stacked in an upright posture between a plate-shaped rectangular fixed frame 11 in an upright posture and a plate-shaped rectangular movable frame 12 in an upright posture as shown in FIG. 7, a first flow path 1 and second flow path 2 are formed alternately between the heat transfer plates 20 as shown in FIG. 8, and a high-temperature fluid H is passed through the first flow path 1 while a low-temperature fluid C is passed through the second flow path 2, thereby exchanging heat between the high-temperature fluid H and low-temperature fluid C.

Passage holes 11*a* to 11*d* serving as inlet ports and outlet ports for the fluids H and C are provided in four corners of the fixed frame 11, whereas no passage hole is provided in the movable frame 12.

Also, passage holes 21 to 24 serving as inlet ports and outlet ports for the fluids H and C are provided in four corners of each of the heat transfer plates 20, a heat transfer portion (not numbered) is provided in an intermediate portion of the heat transfer plate 20, and a gasket 130 is interposed between each adjacent ones of the heat transfer plates 20, for example, such that the upper and lower left passage holes 21 and 22 are communicated with the heat transfer portion while the upper and lower right passage holes 23 and 24 are closed to the heat transfer portion, or vice versa.

The gasket 130 is made up of a flow-path forming gasket 131 configured to surround a periphery (inner side of an outer peripheral edge) of each heat transfer plate 20 and communicating-path forming gaskets 132 configured to surround circumferences of the passage holes 21 to 24, where the flow-path forming gasket 131 and communicating-path forming gaskets 132 may be formed either separately or integrally (not shown).

In the plate heat exchanger, the upper and lower right communicating-path forming gaskets 132 surround the upper and lower right passage holes 23 and 24, thereby forming communicating paths 3 isolated from the upper and lower left passage holes 21 and 22 as well as from the first flow path 1 while the flow-path forming gasket 131 surrounds the upper and lower left passage holes 21 and 22 as well as the heat transfer portion, thereby forming the first flow path 1 adapted to pass the high-temperature fluid H.

Also, in the plate heat exchanger, the upper and lower left communicating-path forming gaskets 132 surround the upper and lower left passage holes 21 and 22, thereby forming communicating paths 3 isolated from the upper and lower right passage holes 23 and 24 as well as from the second flow path 2 while the flow-path forming gasket 131 surrounds the upper and lower right communicating-path forming gaskets 132 as well as the heat transfer portion, thereby forming the second flow path 2 adapted to pass the low-temperature fluid C therethrough.

Thus, in FIG. 8, the high-temperature fluid H flows downward through the first flow path 1 from the upper left passage hole 21 and is discharged through the lower left passage hole 22 while the low-temperature fluid C flows upward through the second flow path 2 from the lower right passage hole 24 and is discharged through the upper right passage hole 23, thereby exchanging heat between the two fluids H and C.

Also, although not illustrated, Patent Literature 1 and the like describe a joined plate heat exchanger in which plural cassette plates constructed by permanently joining peripheries or other portions of two heat transfer plates by laser welding, brazing, or the like are stacked in an upright posture and gaskets are interposed on peripheries of the cassette plates, thereby forming a first flow path or second flow path in the cassette plates and forming the second flow path or first flow path between the cassette plates.

On the other hand, Patent Literature 2 describes a plate heat exchanger comprising a flow-path forming gasket and a communicating-path forming gasket which are integrated into a single gasket and interposed between heat transfer plates, in which part of the flow-path forming gasket and part of the communicating-path forming gasket are arranged side-by-side to provide double (two) gaskets in a border between a heat transfer portion and passage holes. In the plate heat exchanger, the double gaskets are firmly fixed to the heat transfer plates without using an adhesive and in other part, the gasket is bonded to the heat transfer plates using an adhesive.

The double gaskets are interposed between every other pair of the stacked heat transfer plates (alternately), thereby forming a flow path configured to communicate the heat transfer portion and passage holes without double gaskets. Those heat transfer plates which lack double gaskets are subject to deformation due to internal pressure, but since the double gaskets are not bonded to the heat transfer plates with an adhesive, pressure tightness of the plate heat exchanger is improved.

CITATION LIST

Patent Literature

Patent Literature 1: JP 2005-106412 A
Patent Literature 1: JP 9-72686 A

DISCLOSURE OF THE INVENTION

Problems to be Solved by the Invention

In the plate heat exchanger, since the high-temperature fluid H flows in the first flow path 1 as shown in FIG. 9, the flow-path forming gasket 131 configured to form the first flow path 1 is placed in a thermal load environment. Consequently, when used for an extended period of time, the flow-path forming gasket 131 softens or hardens progressively due to oxidative degradation.

Also, the flow-path forming gasket 131 is formed of rubber whose main component is polymer (RH). Consequently, when the flow-path forming gasket 131 is heated by the high-temperature fluid H, the polymer reacts with oxygen ($O_2$) to generate alkyl radicals (R.). Since an outer side (non-wetted side) of the flow-path forming gasket 131 contacts the atmosphere, alkyl radicals (R.) react with oxygen to generate peroxy radicals (ROO.). The peroxy radicals (ROO.) react with polymer (RH) to generate peroxide (ROOH). The peroxide (ROOH) is unstable and readily decomposes itself into alkoxy radicals (RO.) and hydroxyl radicals (OH.).

In short, with the flow-path forming gasket 131 which forms the first flow path 1 through which the high-temperature fluid H flows, creating a thermal load environment, since the non-wetted side is in contact with the atmosphere, oxidation reaction makes polymer, the main component of the rubber, break down, increasing the number of radicals, causing breakage of molecular chains and cross-linking reactions to proceed, and resulting in a loss of elasticity intrinsic to rubber. At the same time, a structurally compressive environment causes compression set to increase, resulting in insufficient surface pressure, and causes cracks to develop, resulting in a rupture. Consequently, the high-temperature fluid H may leak out of the first flow path 1.

Also, with the plate heat exchanger described in Patent Literature 2, although the double gaskets are interposed inside, since the flow-path forming gasket placed along the outer peripheral edge of each heat transfer plate is not formed as a double gasket, oxidative degradation reactions can occur, resulting in external leakage of the high-temperature fluid H.

When the high-temperature fluid H is a dangerous chemical solution, leaking out of the high-temperature fluid H from the plate heat exchanger may cause secondary accidents. If the gaskets are replaced a little earlier to prevent secondary accidents, this will increase running costs. Also, a method is conceivable which inhibits oxidative degradation and prevents the high-temperature fluid H from flowing out, by covering the entire plate heat exchanger with an airtight sheet or the like or inserting rubber or the like into gaps among outer peripheral portions of the stacked heat transfer plates, but such a method is not adopted because of problems in terms of costs and quality.

Thus, an object of the present invention is to provide a plate heat exchanger free from degradation of gaskets which form a flow path through which a high-temperature fluid flows.

Means for Solving Problems

In a plate heat exchanger according to the present invention, a plurality of heat transfer plates each provided with a passage hole in each corner are stacked; a flow-path forming gasket is interposed between peripheries of each adjacent ones of the heat transfer plates; communicating-path forming gaskets are installed, surrounding the passage holes in each adjacent ones of the heat transfer plates alternately; and thereby a first flow path adapted to pass a high-temperature fluid, a second flow path adapted to pass a low-temperature fluid, and communicating paths adapted to cause the fluids to flow in and out of the first flow path and the second flow path are formed alternately on opposite sides of each of the heat transfer plates, wherein the flow-path forming gasket is made up of an inner gasket member and an outer gasket member arranged in two parallel lines.

With this plate heat exchanger, since the flow-path forming gasket is made up of the inner gasket member and the outer gasket member arranged in two parallel lines, the inner gasket member which ensures sealing performance is not exposed to the atmosphere although exposed to the high-temperature fluid. Therefore, breakage of molecular chains and cross-linking reactions due to oxidative degradation reactions do not proceed and consequently increases in compression set and development of cracks are suppressed. This can make the high-temperature fluid less prone to leaking out of the first flow path.

Also, in any of the plate heat exchanger according to the present invention, the flow-path forming gasket may be made up of the inner gasket member and the outer gasket member arranged in two parallel lines only between the heat transfer plates which form the first flow path.

With the plate heat exchanger, in view of the fact that the flow-path forming gasket which forms the first flow path through which the high-temperature fluid flows is prone to degradation due to oxidative degradation reactions, the inner gasket member and the outer gasket member are arranged in two parallel lines only between the heat transfer plates which form the first flow path and the flow-path forming gasket which forms the second flow path through which the low-temperature fluid flows is configured to be a single-line gasket.

In a plate heat exchanger according to the present invention different from the one described above, a plurality of cassette plates are stacked, each of the cassette plates being made up of two heat transfer plates which are provided with a passage hole in each corner and are permanently joined on peripheries; a flow-path forming gasket is interposed between peripheries of each adjacent ones of the cassette plates; communicating-path forming gaskets are installed, surrounding the passage holes in adjacent ones of the cassette plates alternately; and thereby a first flow path adapted to pass a high-temperature fluid and a second flow path adapted to pass a low-temperature fluid in and between the cassette plates are formed alternately, wherein the flow-path forming gasket is made up of an inner gasket member and an outer gasket member arranged in two parallel lines.

With this plate heat exchanger, since the flow-path forming gasket interposed between the cassette plates is made up of the inner gasket member and the outer gasket member arranged in two parallel lines, when the first flow path through which the high-temperature fluid flows is installed between the cassette plates, the flow-path forming gasket can be made less prone to oxidative degradation reactions, progress of gasket degradation can be suppressed, and leakage of the high-temperature fluid from the first flow path can be prevented. Note that although a high-temperature fluid is generally passed through the cassette plates, there are cases in which chemicals or the like are passed through the cassette plates with the high-temperature fluid being passed between the cassette plates.

Also, in the plate heat exchanger according to the present invention, preferably the heat transfer plates have a drain hole formed between the inner gasket member and the outer gasket member of the flow-path forming gasket.

With this plate heat exchanger, since the drain hole is formed in the heat transfer plate between the inner gasket member and the outer gasket member, any high-temperature fluid leaking from the first flow path formed by the inner gasket can be discharged through the drain hole.

Also, in the plate heat exchanger according to the present invention, preferably the heat transfer plates have a gas supply hole formed between the inner gasket member and the outer gasket member between the flow-path forming gaskets; and an enclosed space surrounded by the inner gasket member, the outer gasket member, and the heat transfer plates is filled with an inert gas.

With this plate heat exchanger, since the enclosed space surrounded by the inner gasket member, the outer gasket member, and the heat transfer plate is filled with an inert gas, expelling oxygen from the air existing in the enclosed space, oxidative degradation reactions of the inner gasket member can be reduced to a minimum.

Also, in any of the plate heat exchanger according to the present invention, the flow-path forming gasket may be made up of the inner gasket member and the outer gasket member arranged in two parallel lines only on an upstream side where the high-temperature fluid flows into the first flow path.

With the plate heat exchanger, in view of the fact that the high-temperature fluid has its temperature reduced when flowing on a downstream side of the first flow path, and increased when flowing on the upstream side, the inner gasket member and the outer gasket member are arranged in two parallel lines only on the upstream side where the high-temperature fluid flows into the first flow path and a single-line gasket is provided on the downstream side where the high-temperature fluid flows after having its temperature reduced by heat exchange.

Advantageous Effects of the Invention

The present invention provides a plate heat exchanger in which the flow-path forming gasket is made up of the inner gasket member and the outer gasket member arranged in two parallel lines, suppressing breakage of molecular chains due to oxidative degradation reaction and increases in compression set and development of cracks caused by progress of cross-linking reactions, in the flow-path forming gasket and thereby making the high-temperature fluid in the first flow path less prone to leaking out of the first flow path.

DESCRIPTION OF EMBODIMENTS

Figure 1:
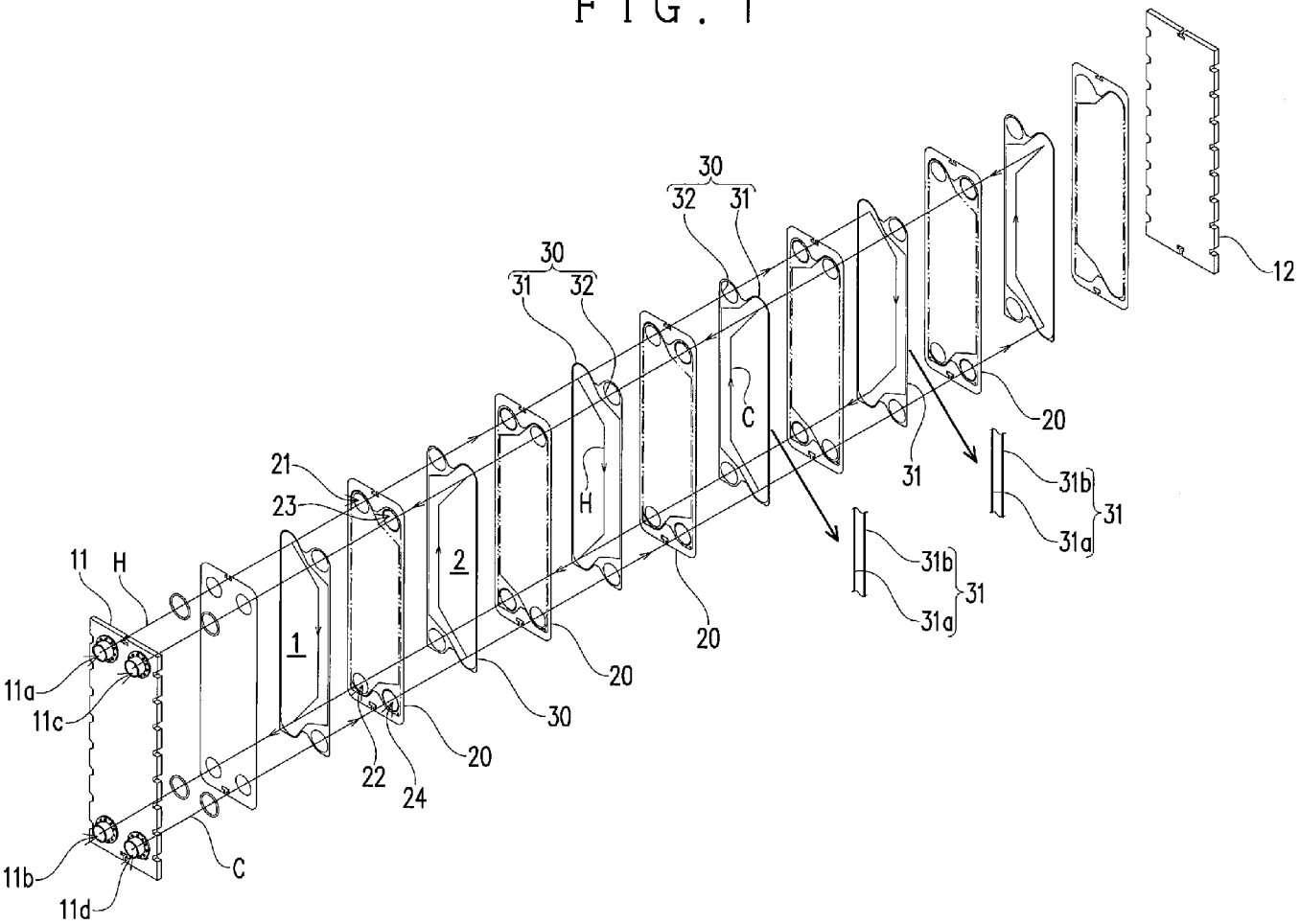
FIG. 1 is a schematic exploded perspective view showing a plate heat exchanger according to a first embodiment of the present invention.

A plate heat exchanger according to a first embodiment of the present invention is described below with reference to FIGS. 1 and 2. The same components as conventional components are denoted by the same reference numerals as the corresponding conventional components, and description thereof is omitted. In the following description, positional terms such as upper, lower, right, and left are exemplary in each embodiment, and, needless to say, may represent different positions depending on actual usage.

Figure 2:
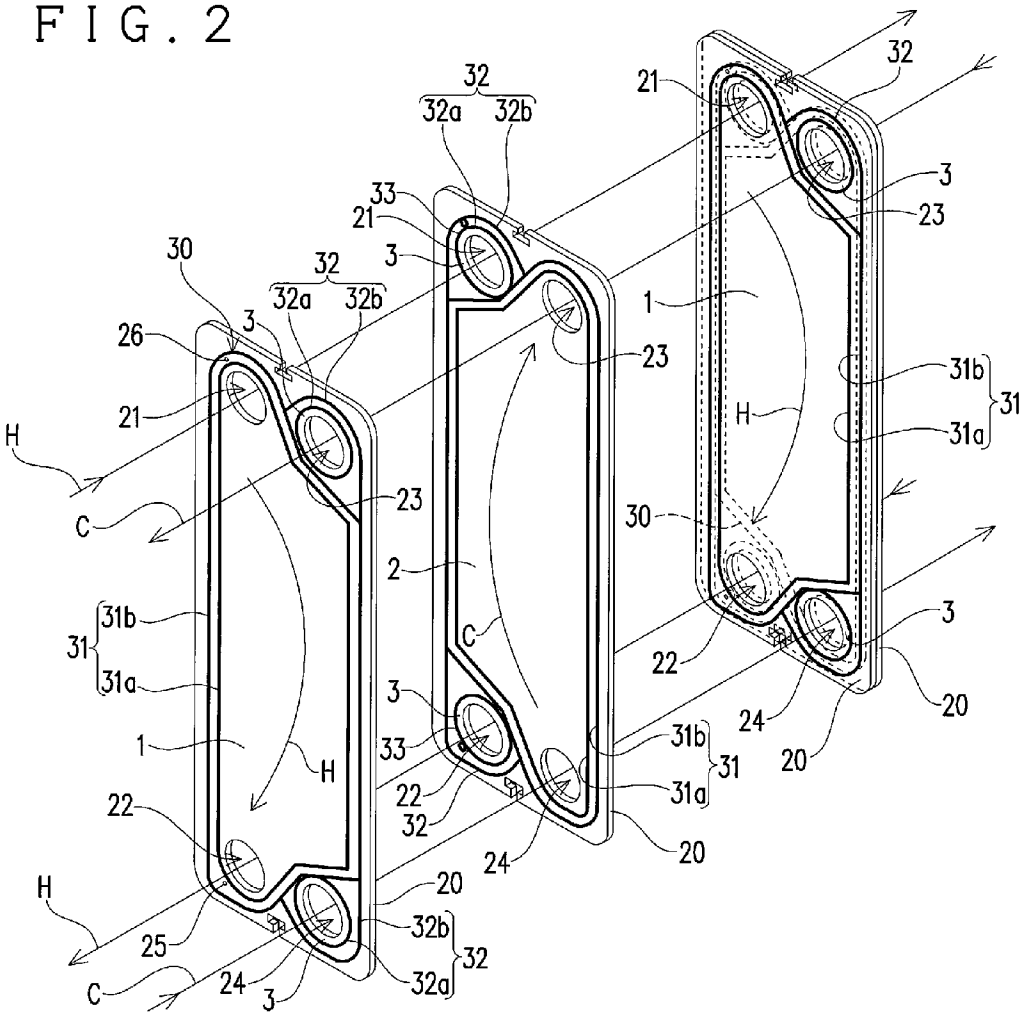
FIG. 2 is a schematic exploded perspective view showing principal part of the plate heat exchanger according to the first embodiment of the present invention.

As is conventionally the case, the plate heat exchanger according to the first embodiment is an apparatus in which a first flow path 1 and a second flow path 2 are formed alternately between heat transfer plates 20 as shown in FIGS. 1 and 2, a high-temperature fluid H is passed through the first flow path 1 while a low-temperature fluid C is passed through the second flow path 2, and the first flow paths 1 and the second flow paths 2 are formed by respective gaskets 30 interposed between the heat transfer plates 20.

The gaskets 30 each are made up of a flow-path forming gasket 31 configured to surround a periphery of each heat transfer plate 20 and a communicating-path forming gasket 32 configured to surround circumferences of the passage holes 21 to 24, where the flow-path forming gasket 31 and communicating-path forming gasket 32 may be formed either integrally or separately (not shown). The gasket 30 in which the flow-path forming gasket 31 and communicating-path forming gasket 32 are formed integrally is based on shared use of a border between a heat transfer portion and the passage holes 21 to 24.

In the plate heat exchanger according to the first embodiment, as shown in FIG. 2, the flow-path forming gasket 31 is made up of an inner gasket member 31*a* and an outer gasket member 31*b* arranged in two parallel lines, and a distance between the inner gasket member and the outer gasket member becomes gradually larger from a laterally outer side and a lower side of the corresponding passage hole. The communicating-path forming gasket 32 is also made up of an inner gasket member 32*a* and an outer gasket member 32*b* arranged in two parallel lines. Hereinafter, the flow-path forming gasket 31 and the communicating-path forming gasket 32 made up of the inner gasket member 31*a* or 32*a* and the outer gasket member 31*b* or 32*b* arranged in two parallel lines will be referred to as double-line gaskets 30.

Each heat transfer plate 20 is double-grooved to correspond to the inner gasket member 31*a* or 32*a* and the outer gasket member 31*b* or 32*b* of the flow-path forming gasket 31 and the communicating-path forming gasket 32.

In this way, as the flow-path forming gasket 31 is interposed between each adjacent ones of the heat transfer plates 20, the inner gasket member 31*a* surrounds the upper and lower left passage holes 21 and 22 as well as the heat transfer portion, thereby forming the first flow path 1 while the upper and lower right communicating-path forming gaskets 32 surround the upper and lower right passage holes 23 and 24, thereby forming communicating paths 3 isolated from the first flow path 1.

Besides, the flow-path forming gasket 31 surrounds the upper and lower right passage holes 23 and 24 as well as the heat transfer portion, thereby forming the second flow path 2 while the communicating-path forming gaskets 32 surround the upper and lower left passage holes 21 and 22, thereby forming the communicating paths 3 isolated from the second flow path 2. Incidentally, the outer gasket member 31*b* of the flow-path forming gasket 31 and the outer gasket member 32*b* of the communicating-path forming gasket 32 are formed by a common member.

As the gaskets 30 in which the flow-path forming gasket 31 and the communicating-path forming gasket 32 are formed integrally are interposed between adjacent heat transfer plates 20 alternately, the high-temperature fluid H flows through the first flow path 1 from the upper left passage hole 21 and is discharged through the lower left passage hole 22 while the low-temperature fluid C flows through the second flow path 2 from the lower right passage hole 24 and is discharged through the upper right passage hole 23, thereby exchanging heat between the high-temperature fluid H and the low-temperature fluid C.

In so doing, the high-temperature fluid H flowing through the first flow path 1 contacts the inner gasket member 31*a* of the flow-path forming gasket 31, but the inner gasket member 31*a*, whose outer side is surrounded by the outer gasket member 31*b*, does not contact the atmosphere, and is thus less prone to oxidative degradation reactions.

Besides, since the communicating-path forming gasket 32 is also made up of the inner gasket member 32*a* and the outer gasket member 32*b* arranged in two parallel lines, the inner gasket member 32*a* of the communicating-path forming gasket 32 which forms the communicating path 3 by surrounding the communicating hole 21 is surrounded by the outer gasket member 32*b*, and is thus also less prone to oxidative degradation reactions even if placed in contact with the high-temperature fluid H.

Thus, in the plate heat exchanger, the double-line gaskets 30 suppress breakage of molecular chains due to oxidative degradation reaction and progress of gasket degradation (compression set, development of cracks, and the like) caused by progress of cross-linking reactions, and thereby makes the high-temperature fluid H less prone to leak.

Next, a plate heat exchanger according to a second embodiment of the present invention is described without illustration. The low-temperature fluid C flows through the second flow paths 2, creating conditions under which the gaskets forming the second flow path 2 are less prone to oxidative degradation reactions due to heat. Thus, in the plate heat exchanger according to the second embodiment, a conventionally-used typical gasket (hereinafter referred to as a "single-line gasket") 130 in which the inner gasket member 31*a* and the outer gasket member 31*b* are not arranged in two parallel lines is interposed between two adjacent heat transfer plates 20 to form the second flow path 2.

With the heat transfer plate 20 used in the second embodiment, grooves for the double-line gasket 30 are formed in one face and a groove for the single-line gasket 130 is formed in another face. Thus, the plate heat exchanger according to the second embodiment is assembled by alternately stacking the heat transfer plates 20 by taking these grooves into consideration.

Figure 3:
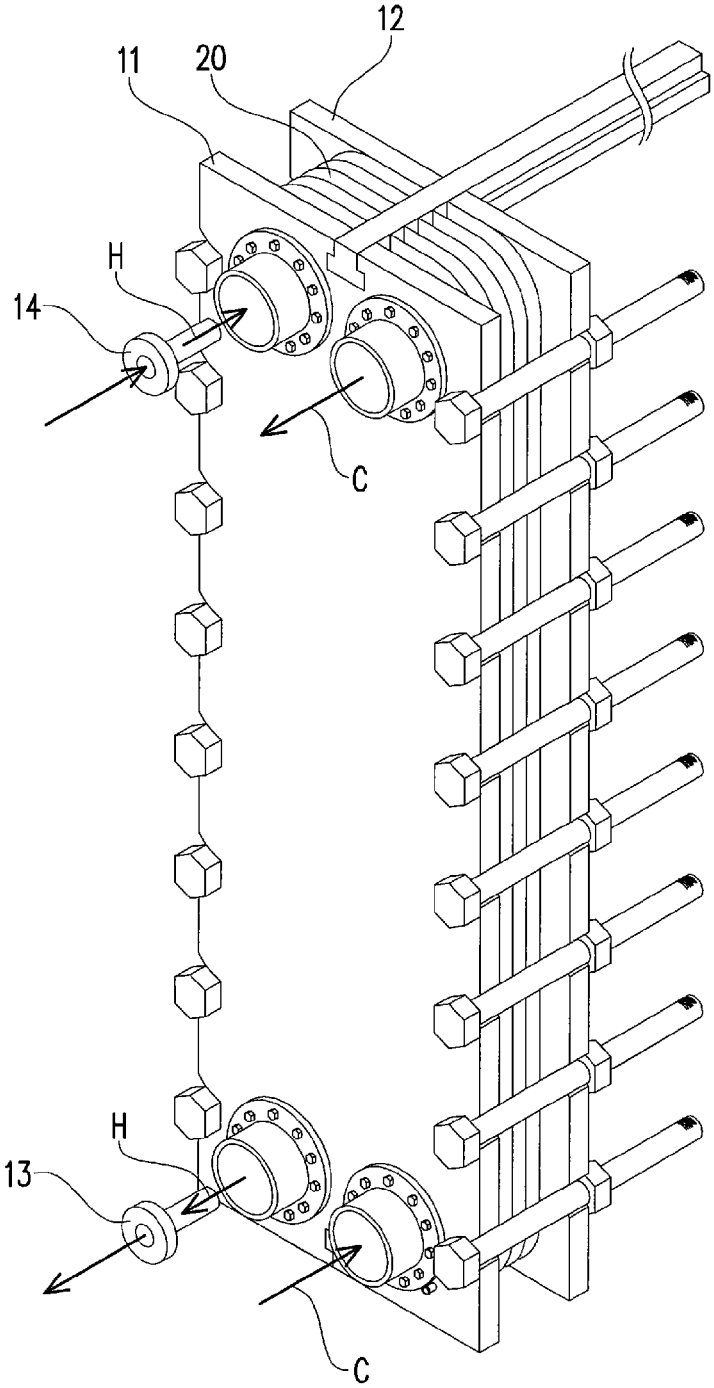
FIG. 3 is a schematic exploded perspective view showing a plate heat exchanger according to a third embodiment of the present invention.
Figure 4:
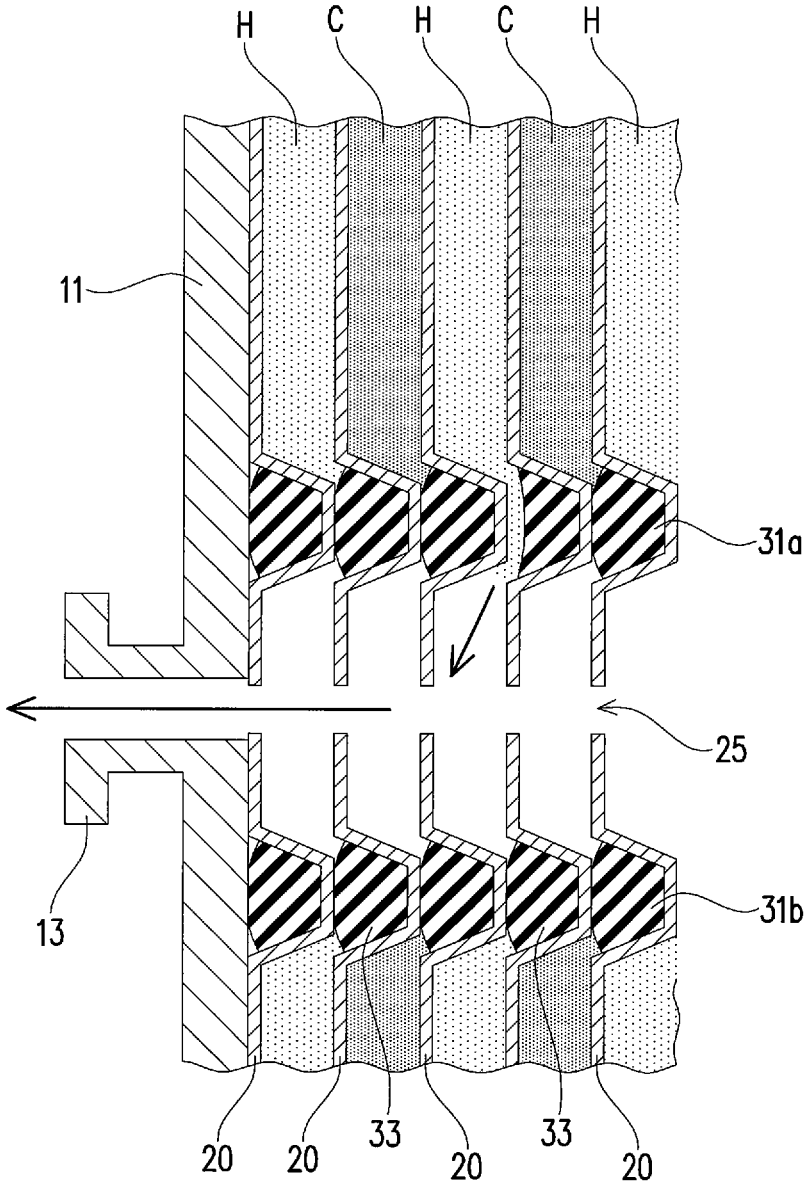
FIG. 4 is an enlarged sectional view showing principal part of the plate heat exchanger according to the third embodiment of the present invention.

Next, a plate heat exchanger according to a third embodiment of the present invention is described below with reference to FIGS. 2 to 4. According to the third embodiment, a drain hole 25 and/or a gas supply hole 26 are provided in the heat transfer plate 20 sandwiched between the inner gasket members 31*a* and 32*a* and the outer gasket members 31*b* and 32*b* of the double-line gasket 30.

The drain hole 25 is provided in lower part of the heat transfer plate 20 to discharge any high-temperature fluid H leaking out of the first flow path 1 when the inner gasket members 31*a* and 32*a* of the double-line gasket 30 degrade. To ensure that the high-temperature fluid H discharged through the drain hole 25 will not flow into the communicating path 3 isolated from the adjacent second flow path 2, an annular gasket 33 is interposed between the heat transfer plates 20 between which the second flow path 2 is formed.

A nozzle 13 continuous with the drain hole 25 is mounted on the fixed frame 11 and any leakage of the high-temperature fluid H from the nozzle 13 can be detected.

Also, the gas supply hole 26 is formed to supply an inert gas such as nitrogen to an enclosed space surrounded by the inner gasket members 31*a* and 32*a* and the outer gasket members 31*b* and 32*b* of the double-line gasket 30 and the two heat transfer plates 20, expelling oxygen from the air existing in the enclosed space, and thereby making the inner gasket members 31*a* and 32*a* still less prone to oxidative degradation reactions.

It is sufficient if the gas supply hole 26 is supplied only to the enclosed space formed by the double-line gasket 30 which forms the first flow path 1, but it may also be supplied to the enclosed space formed by the double-line gasket 30 which forms the second flow path 2.

However, when the second flow path 2 is formed by the single-line gasket 130, an annular gasket (not shown) used to supply an inert gas in isolation from the second flow path 2 or outside the second flow path 2 is interposed between the heat transfer plates 20 between which the second flow path 2 is formed.

Also, although the gas supply hole 26 may be provided at any location, the gas supply hole 26 is provided preferably in upper part of the assembled heat transfer plate 20 by assembling the heat transfer plate 20 upside down, such that the gas supply hole 26 can act as the drain hole 25. Incidentally, a nozzle 14 for use to supply an inert gas to the gas supply hole 26 is mounted on the fixed frame 11.

Figure 5:
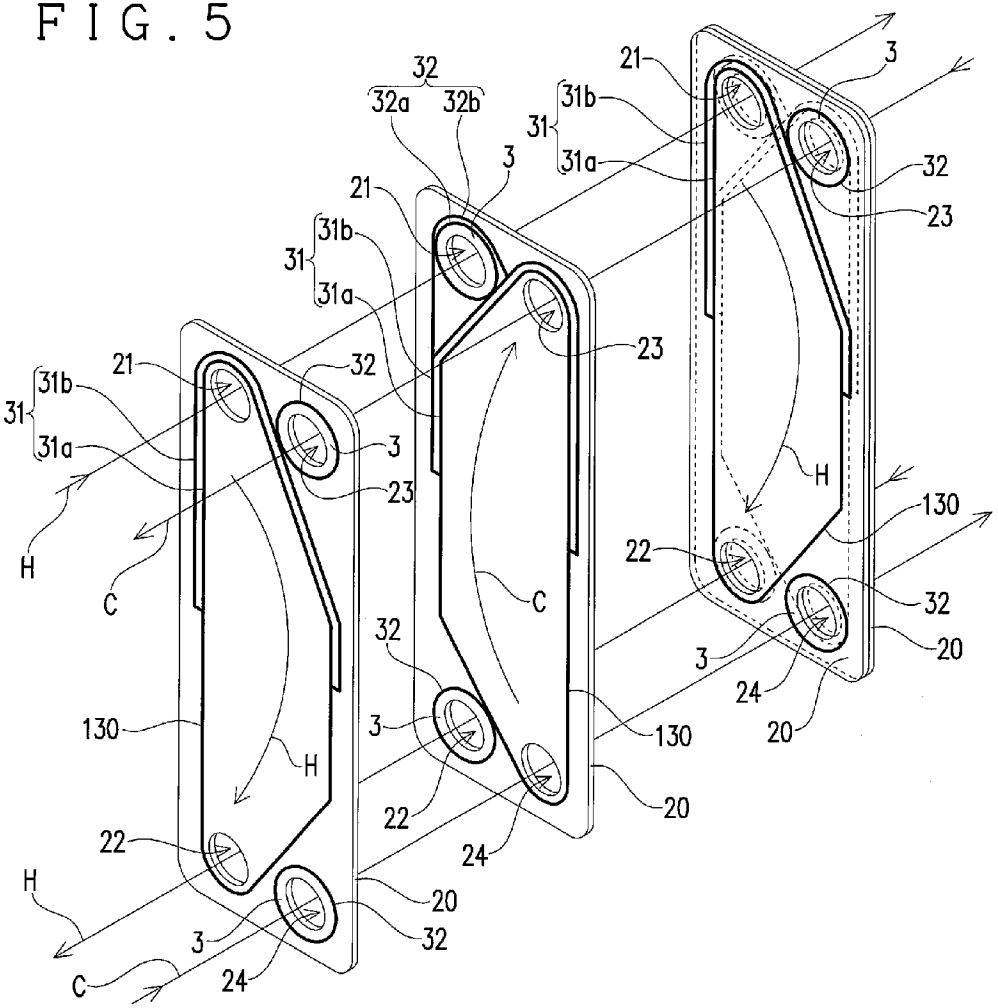
FIG. 5 is an exploded perspective view showing a plate heat exchanger according to a fourth embodiment of the present invention.

Next, a plate heat exchanger according to a fourth embodiment of the present invention is described below with reference to FIG. 5. According to the fourth embodiment, the double-line gasket 30 is made up of the inner gasket members 31*a* and 32*a* and the outer gasket members 31*b* and 32*b* arranged in two parallel lines only on the upstream side of the first flow path 1. While exchanging heat with the low-temperature fluid C, the high-temperature fluid H in the first flow path 1 flows from the upper left passage hole 23 (on the upstream side) to the lower left passage hole 24 (on the downstream side), thereby causing temperature falls on the downstream side.

Therefore, when the single-line gasket 130 is installed on the downstream side of the first flow path 1, the single-line gasket 130 is less prone to oxidative degradation reactions due to heat. Thus, by installing the double-line gasket 30 only on the upstream side of the first flow path 1 and installing the single-line gasket 130 on the downstream side of the first flow path 1, it is also possible to prevent progress in oxidative degradation of the double-line gasket 30 due to heat and thereby keep the high-temperature fluid H from leaking.

Note that a drain hole (not shown) may be formed in lower end part of the double-line gasket 30, with a gas supply hole (not shown) being formed in any heat transfer plate 20 between the inner gasket members 31*a* and the outer gasket members 31*b*.

Figure 6:
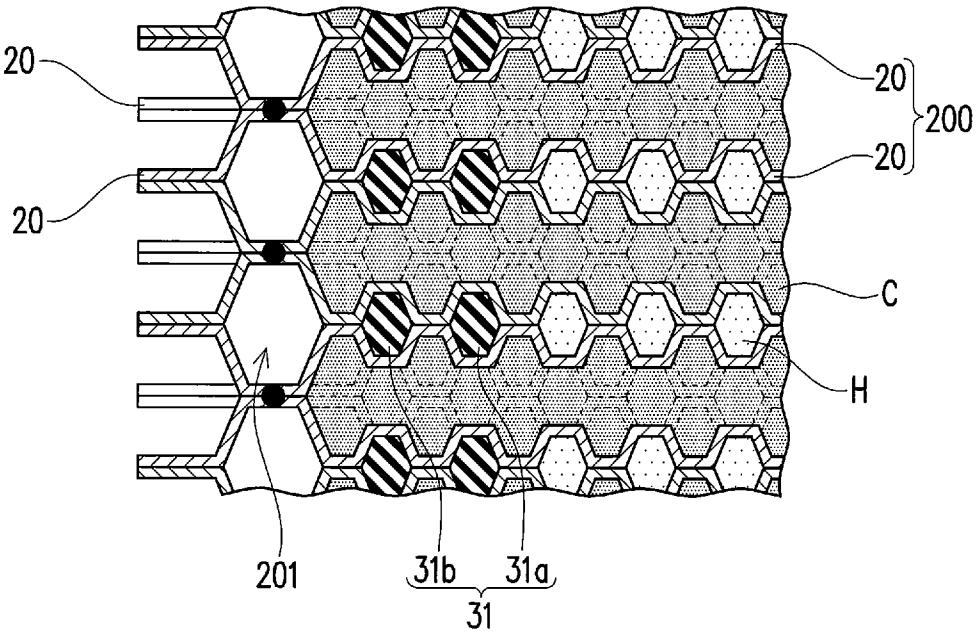
FIG. 6 is an enlarged sectional view showing principal part of a plate heat exchanger according to a fifth embodiment of the present invention.
Figure 7:
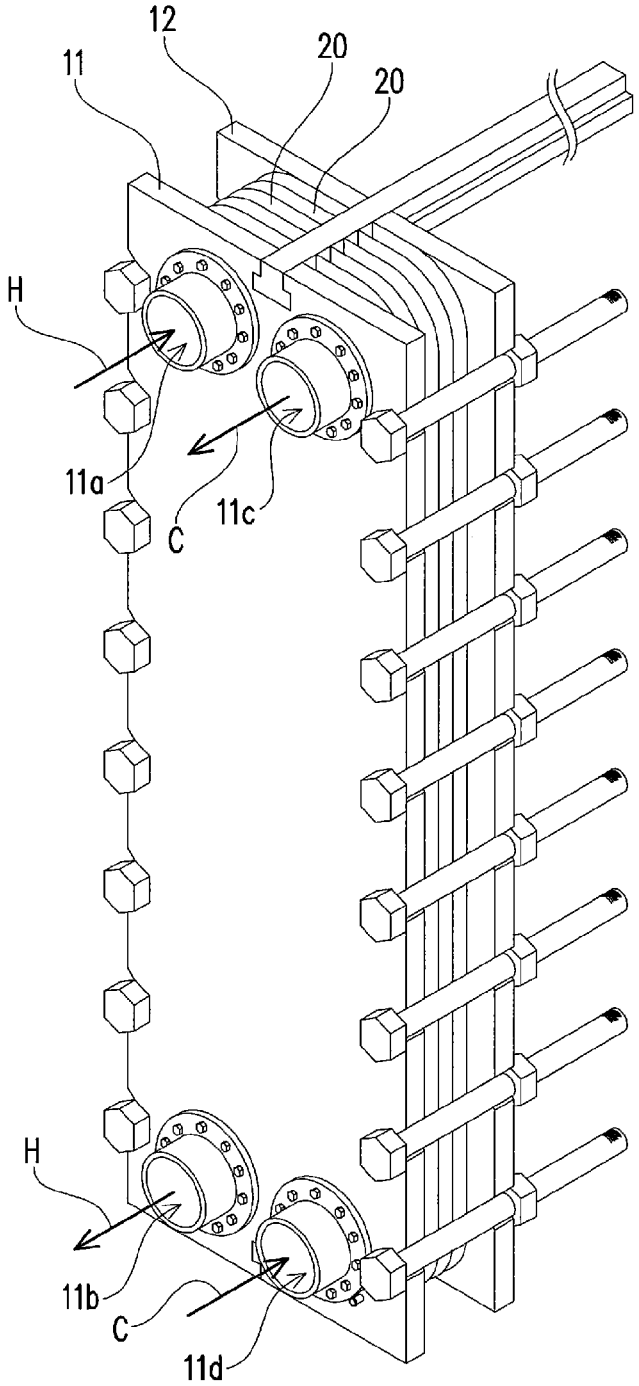
FIG. 7 is a schematic perspective view showing a conventional plate heat exchanger.
Figure 8:
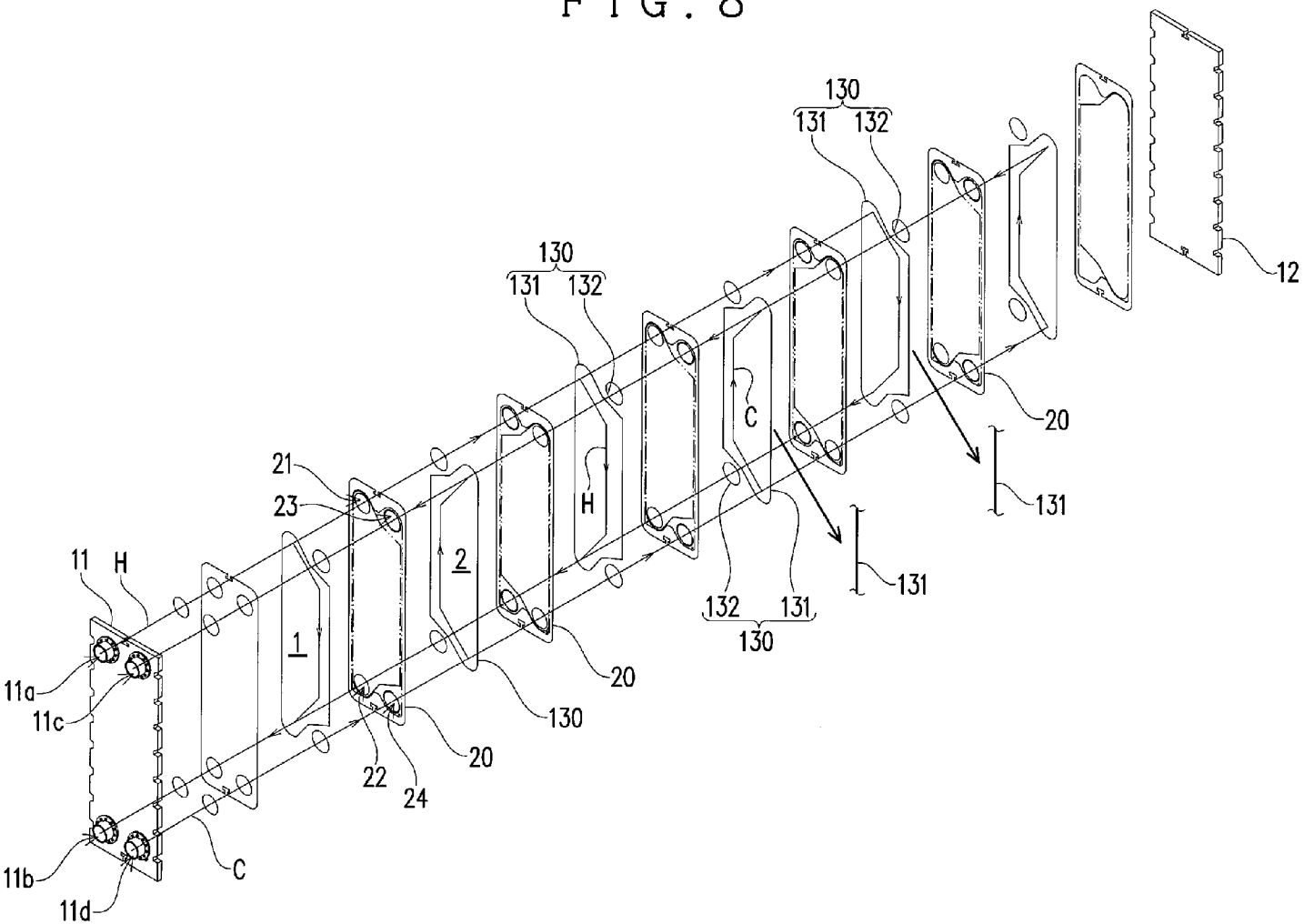
FIG. 8 is a schematic exploded perspective view showing the conventional plate heat exchanger.
Figure 9:
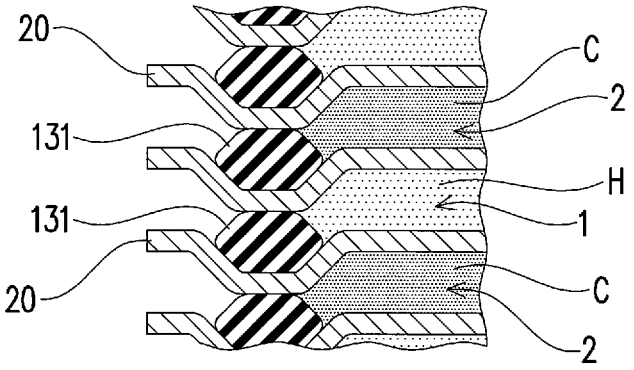
FIG. 9 is an enlarged sectional view of principal part showing principal part of the conventional plate heat exchanger.

Next, a plate heat exchanger according to a fifth embodiment of the present invention is described below with reference to FIG. 6. According to the fifth embodiment, double-line gaskets 30 are interposed between plural cassette plates 200 stacked in an upright posture. Incidentally, only the flow-path forming gaskets 31 of the double-line gaskets 30 are illustrated in FIG. 6.

The cassette plate 200 is constructed by permanently joining peripheries of two heat transfer plates 20 by laser welding, brazing, or the like (indicated by black dots in FIG. 6), and the first flow path 1 adapted to pass the high-temperature fluid H or the second flow path 2 adapted to pass the low-temperature fluid C is provided therein.

Plural cassette plates 200 are stacked, and the second flow path 2 adapted to pass the low-temperature fluid C or the first flow path 1 adapted to pass the high-temperature fluid H is provided between each adjacent ones of the cassette plates 200. The double-line gaskets 30 are interposed between the peripheries of the stacked cassette plates 200.

That is, the double-line gasket 30 is made up of the inner gasket member 31*a* (ditto for 32*a* although not illustrated) on the wetted side and the outer gasket member 31*b* (ditto for 32*b* although not illustrated) on the non-wetted side arranged in two parallel lines. The outer gasket member 31*b* (ditto for 32*b* although not illustrated) is installed inside the permanently joined portions as illustrated.

Alternatively, although not illustrated, the outer gasket member may be installed in a space 201 between the permanently joined portions and the inner gasket member 31*a* may be installed inward from the permanently joined portion (a line on which the outer gasket member 31*b* is installed in FIG. 6).

Whereas with the conventional plate heat exchanger in which the cassette plates 200 are stacked, the first flow path 1 adapted to pass the high-temperature fluid H is provided in the cassette plate 200, with the plate heat exchanger according to the fifth embodiment, the second flow path 2 may be provided in the cassette plate 200 with the first flow path 1 being provided between the cassette plates 200. This is because the double-line gasket 30 will also be interposed between the stacked cassette plates 200 in this way, making the double-line gasket 30 less prone to oxidative degradation reactions due to heat.

Then, a chemical solution, which is a low-temperature fluid C, can be passed smoothly through the second flow path 2 provided in the cassette plate 200. Consequently, in the plate heat exchanger, when a chemical solution is passed between the cassette plates 200, it is sufficient to install a chemical-proof gasket only on a ring gasket.

Note that the present invention is not limited to the first to fifth embodiments described above and that various changes can be made to the embodiments. For example, the plate heat exchanger described in the fifth embodiment in which the cassette plates 200 are stacked may be provided with the exhaust hole and the gas supply hole 26 described in the third embodiment. Also, the double-line gasket 30 may be installed only on the upstream side of the first flow path 1 as described in the fourth embodiment. Also, the nozzle 13 continuous with the drain hole 25 and the nozzle 14 continuous with the gas supply hole 26 may be installed on the movable frame 12 rather than on the fixed frame 11.

REFERENCE SIGNS LIST

1 . . . First flow path
2 . . . Second flow path
3 . . . Communicating path
20 . . . Heat transfer plate
21, 22, 23, 24 . . . Passage hole
25 . . . Drain hole
26 . . . Gas supply hole
30 . . . Gasket (double-line gasket)
31 . . . Flow-path forming gasket
31*a* . . . Inner gasket member
31*b* . . . Outer gasket member
32 . . . Communicating-path forming gasket
32*a* . . . Inner gasket member
32*b* . . . Outer gasket member
130 . . . Flow-path forming gasket (single-line gasket)
200 . . . Cassette plate
C . . . Low-temperature fluid
H . . . High-temperature fluid

What is claimed is:

1. A plate heat exchanger comprising:

a plurality of heat transfer plates that have a rectangular shape and are stacked to each other in an upright posture, each heat transfer plate provided with a plurality of passage holes, each of the passage holes being arranged in each corner of the heat transfer plate;

flow-path forming gaskets, each flow-path forming gasket interposed between each adjacent ones of the heat transfer plates in periphery thereof; and communicating-path forming gaskets, surrounding the plurality of passage holes in each adjacent ones of the heat transfer plates alternately, thereby a first flow path adapted to pass a high-temperature fluid, and a second flow path adapted to pass a low-temperature fluid are formed alternately on opposite sides of each of the heat transfer plates, wherein a first communicating path adapted to cause the high-temperature fluid to flow in and out of the first flow path through a pair of upper and lower ones of the plurality of passage holes, and a second communicating path adapted to cause the low-temperature fluid to flow in and out of the second flow path through a pair of upper and lower ones of the plurality of passage holes, which are different from the first communicating path, are formed alternately in the stacked heat transfer plates, wherein at least one of the flow-path forming gaskets comprises an inner gasket member and an outer gasket member arranged in two parallel lines, wherein a space defined between the inner gasket member and the outer gasket member contains none of the plurality of passage holes, wherein each of the plurality of heat transfer plates are double-grooved to correspond to the inner gasket member and the outer gasket member, wherein the pair of upper and lower passage holes for causing the high-temperature fluid to flow in and out of the first flow path are surrounded by the flow-path forming gasket, wherein the pair of upper and lower passage holes for causing the low-temperature fluid to flow in and out of the second flow path are surrounded by the flow-path forming gasket, wherein a distance between the inner gasket member and the outer gasket member becomes gradually larger from a laterally outer side and a lower side of the corresponding passage hole surrounded by the flow-path forming gasket and formed on a side close to the corresponding lower corner of the heat transfer plate toward the corresponding lower corner of the heat transfer plate, and wherein a drain hole is formed in a space between the inner gasket member and the outer gasket member to be located at a point on a laterally outer side of the heat transfer plate and a diagonally downward side relative to an axial center of the passage hole formed on a side close to the corresponding lower corner of the heat transfer plate.

2. The plate heat exchanger according to claim 1, wherein the heat transfer plates have a gas supply hole formed between the inner gasket member and the outer gasket member between the flow-path forming gaskets; and an enclosed space surrounded by the inner gasket member, the outer gasket member, and the heat transfer plates is filled with an inert gas.

3. The plate heat exchanger according to claim 1, further comprising a plurality of cassette plates stacked to each other, each cassette plate being made up of the two heat transfer plates of the stacked plurality of heat transfer plates which are permanently joined on peripheries, wherein a flow-path forming gasket is interposed between peripheries of each adjacent ones of the cassette plates, wherein the communicating-path forming gaskets are installed to surround the passage holes in adjacent ones of the cassette plates alternately so that the first flow path and the second flow path are formed alternately in the inside of each cassette plate and between the adjacent cassette plates.

* * * * *